US011760524B2

(12) United States Patent
Segroves

(10) Patent No.: US 11,760,524 B2
(45) Date of Patent: Sep. 19, 2023

(54) ELONGATED OBJECT LABEL APPLICATOR GUIDE

(71) Applicant: Panduit Corp., Tinley Park, IL (US)

(72) Inventor: Roger D. Segroves, Lockport, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 17/699,762

(22) Filed: Mar. 21, 2022

(65) Prior Publication Data

US 2022/0204204 A1 Jun. 30, 2022

Related U.S. Application Data

(62) Division of application No. 16/507,708, filed on Jul. 10, 2019, now Pat. No. 11,305,909.

(51) Int. Cl.

| | |
|---|---|
| ***B65C 3/02*** | (2006.01) |
| ***B65C 9/18*** | (2006.01) |
| ***B65C 9/42*** | (2006.01) |

(52) U.S. Cl.
CPC ..... *B65C 3/02* (2013.01); *B65C 9/18* (2013.01); *B65C 9/42* (2013.01)

(58) Field of Classification Search
CPC ..... B65C 9/18; B65C 3/02; B65C 9/42
See application file for complete search history.

(56) References Cited

U.S. PATENT DOCUMENTS

| | | | |
|---|---|---|---|
| 3,245,860 | A | 4/1966 | Aurich et al. |
| 3,337,103 | A | 8/1967 | Walus et al. |
| 6,742,858 | B2 | 6/2004 | Lehmkuhl et al. |
| 6,875,304 | B2 | 4/2005 | Schanke et al. |
| 7,178,572 | B2 | 2/2007 | Schanke et al. |
| 7,231,952 | B2 | 6/2007 | Schanke et al. |
| 7,469,736 | B2 | 12/2008 | Fries et al. |
| 7,717,149 | B2 | 5/2010 | Johnson |
| 7,757,739 | B2 | 7/2010 | Fries et al. |
| 8,033,312 | B2 | 10/2011 | Fries et al. |
| 8,186,408 | B2 | 5/2012 | Fries et al. |
| 8,545,666 | B2 | 10/2013 | Grove |
| 8,783,318 | B2 | 7/2014 | Witkiewicz |
| 8,826,960 | B1 | 9/2014 | Bennett et al. |
| 8,905,108 | B2 | 12/2014 | Brooks |
| 9,321,548 | B1 | 4/2016 | Bennett et al. |
| 9,409,668 | B1 | 8/2016 | Brooks |
| 9,446,877 | B1 | 9/2016 | Bennett et al. |
| 9,452,856 | B1 | 9/2016 | Brooks |
| 2004/0211522 | A1 | 10/2004 | Fries et al. |
| 2008/0073023 | A1 | 3/2008 | Fries et al. |

FOREIGN PATENT DOCUMENTS

| | | |
|---|---|---|
| CN | 207467132 U | 6/2018 |
| WO | 8801247 A1 | 2/1988 |

*Primary Examiner* — Michael A Tolin
*Assistant Examiner* — Christopher C Caillouet
(74) *Attorney, Agent, or Firm* — Christopher S. Clancy; James H. Williams; Peter S. Lee

(57) ABSTRACT

A label applicator guide including a base configured to be attached to an elongated object label applicator, and a controller including a first support extending from the base and a second support extending from the first support such that the first support is configured to be planar with a portion of the wrapping mechanism. The controller is moveably secured to the base through a first knuckle of the controller pivotably connected to a second knuckle of the base, with a pin extending through the first knuckle and second knuckle.

8 Claims, 7 Drawing Sheets

ELONGATED OBJECT LABEL APPLICATOR GUIDE

CROSS-REFERENCE TO RELATED APPLICATION(S)

The application is a divisional of U.S. patent application Ser. No. 16/507,708, filed on Jul. 10, 2019, now U.S. Pat. No. 11,305,909, the entirety of which is hereby incorporated by reference herein.

TECHNICAL FIELD

The invention relates to a label applicator guide for use in labeling of elongated objects; more particularly, the invention relates to a guide for placing wrapping labels at a set location about wires, cables, and the like.

BACKGROUND

Labeling of wires and cables has traditionally been accomplished manually or by way of apparatuses requiring cumbersome, noisy hydraulic or high-pressure air lines. Typically, such machines grasp two points of a section of the wire and pull this section of wire taut. Once the wire is pulled taut, a label applicator or platform orbits around the taut section of wire to apply the label to the wire. This labeler must be capable of orbiting around the wire while applying an appropriate amount and type of pressure between the labeler and the wire. Because the wire or object to be wrapped may take on various shapes or sizes, this can complicate the design and operation of such wire labelers.

More recently, elongated object label applicators have been developed to solve the problems discussed above and other problems, and to provide advantages and aspects not provided by prior labeling devices of this type. One such elongated object label applicator is disclosed in U.S. patent application Ser. No. 16/279,298 assigned to Panduit Corp., which is incorporated by reference herein.

In using a label applicator such as the one disclosed in U.S. patent application Ser. No. 16/279,298, it is desirable to apply a label at a set or specific distance from an end of a wire, cable, and the like. In many instances, industry standards and requirements determine a set or measured distance from the end of the wire or cable in which the label is to be applied for consistency, clarity, and safety. Present label applicators, such as the Wraptor A6500 Wrap Printer Applicator manufactured by Brady Worldwide, Inc., include a fixed measurement indicia/indicator for measuring the location of the applied label from the end of the wire or cable. Fixed measurement indicia/indicators and other present measurement application lack the ability to place the wire or cable a set or measured distance from the end of the wire or cable and hold that measurement while simultaneously feeding the wire into the label applicator. Operators or users must measure by a visual estimate when feeding the wire or cable into the label applicator. Current label applicators lack the ability to safely and consistently label a wire or cable at a set or measured distance from the end of the wire or cable The present invention is provided to solve the problems of fixed measurement indicia discussed above and other problems, and to provide advantages and aspects not provided in recent labeling applicators of this type. A full discussion of the features and advantages of the present invention is deferred to the following detailed description, which proceeds with reference to the accompanying drawings.

SUMMARY

In one example, according to the teachings of the present invention, an elongated object label applicator of the present invention may include a wrapping mechanism configured to apply a label to an elongated object and a label applicator guide including a base and a controller that is moveably secured to the base adjacent to the wrapping mechanism to guide the elongated object into the wrapping mechanism to apply the label.

In one example, the controller of the elongated object label applicator may be moveably secured to the base in a pivoting relationship through a first knuckle of the controller pivotably connected to a second knuckle of the base, with a pin extending through the first knuckle and second knuckle.

In one example, the base of the elongated object label applicator includes a top portion, side portion, and base portion in a C-shaped configuration forming a channel and the channel of the base mates to a base plate of the elongated object label applicator.

In one example, the label applicator guide of the elongated object label applicator includes indicia for measuring a length of the elongated object placed in the wrapping mechanism.

In one example, the controller of the elongated object label applicator pivots about the base to guide the elongated object into the wrapping mechanism.

In one example, the wrapping mechanism of the elongated object label applicator includes a wire guide configured to cradle the elongated object and direct the elongated object into a central portion of the wrapping mechanism, and the controller is configured to move in unison with the wire guide.

In one example, the controller of the elongated object label applicator includes a first support extending from the base and a second support extending from the first support such that the second support is planar with a wire guide of the wrapping mechanism.

In one example, the second support of the elongated object label applicator includes indicia for measuring a length of the elongated object placed in the wrapping mechanism.

In one example, according to the teachings of the present invention, a label applicator guide includes a base configured to be attached to an elongated object label applicator, and a controller including a first support extending from the base and a second support extending from the first support such that the second support is configured to be planar with a portion of the wrapping mechanism. The controller is moveably secured to the base through a first knuckle of the controller being pivotably connected to a second knuckle of the base, with a pin extending through the first knuckle and second knuckle.

In one example, the base of the label applicator guide includes a top portion, side portion, and base portion in a C-shaped configuration forming a channel and wherein the channel of the base is configured to mate to an elongated object label applicator.

In one example, the label applicator guide may also include indicia configured to measure a length of an elongated object placed in a wrapping mechanism.

In one example, according to the teachings of the present invention, a method of applying an adhesive label to an elongated object at a set distance comprising the steps of feeding a label from a source of labels to a wrapping mechanism of an elongated object label applicator; aligning an elongated object with indicia of a label applicator guide;

placing the elongated object within a wire guide of the wrapping mechanism; depressing the wire guide and label applicator guide to place the elongated object within the wrapping mechanism; and rotating a rotational device of the wrapping mechanism about an axis of rotation to apply the label.

BRIEF DESCRIPTION OF THE DRAWINGS

To understand the present invention, it will now be described by way of example, with reference to the accompanying drawings in which.

DETAILED DESCRIPTION

The disclosed label applicator guide solves or improves upon one or more of the noted disadvantages with presently known elongated object label applicators and current fixed measurement indicators. The present invention of a label applicator guide Provides for a consistent and safe application of a label to a wire or cable at a set or measured distance from the end of the wire or cable.

Figure 1:
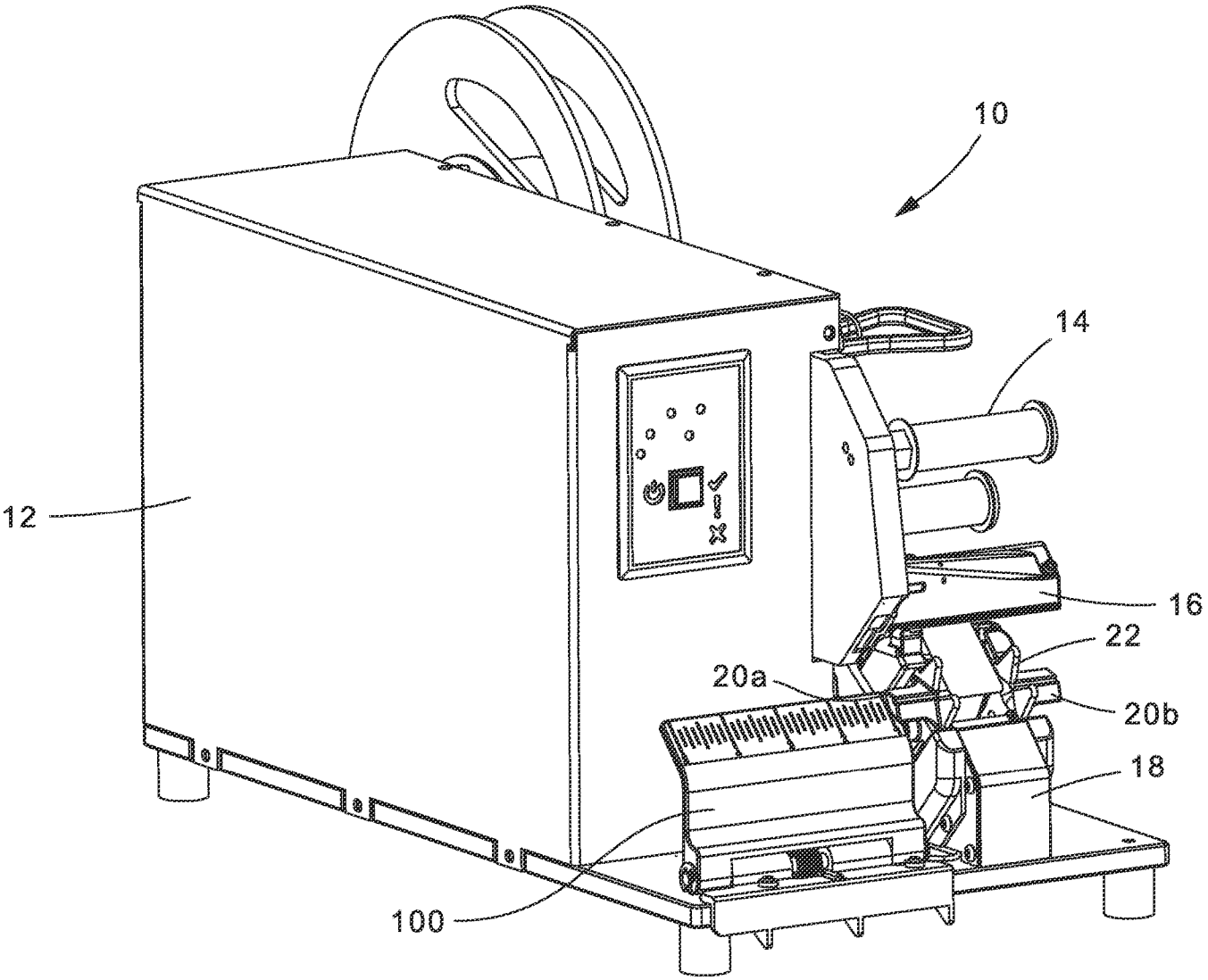
FIG. 1 is a perspective view of the present invention installed on an elongated label applicator.

Turning to the drawings, FIG. 1 depicts an elongated object label applicator 10 with an attached a label applicator guide 100.

As discussed above, label applicators 10 are apparatuses for applying printed labels to wires, cables or other elongated objects of varying diameters. Labels are wrapped around the objects without spinning the objects about their elongated longitudinal axis. The apparatuses are particularly useful for label types that require that the label be wrapped around an object using more than one revolution. Self-laminating labels are one such type, requiring a transparent end of the label to be wrapped over top of a printed region to provide protection to the printed content.

Label applicators 10 are comprised of several systems. These systems include a label applicator or printer 12, a media roller or incoming conveyor 14, a label peel-and-present mechanism 16, and a wrapping mechanism 18. The wrapping mechanism 18 includes a rotational device driven by a driver as further detailed in U.S. patent application Ser. No. 16/279,298. The wrapping mechanism 18 depicted in FIG. 1 further includes a first wire guide 20*a* and a second wire guide 20*b*. The wire guides 20*a*, 20*b* will be described further below. The present invention of the label applicator guide 100 is configured to be mounted to the label applicator to accurately apply a label at a set distance within the wrapping mechanism all in a uniform motion.

Figure 2:
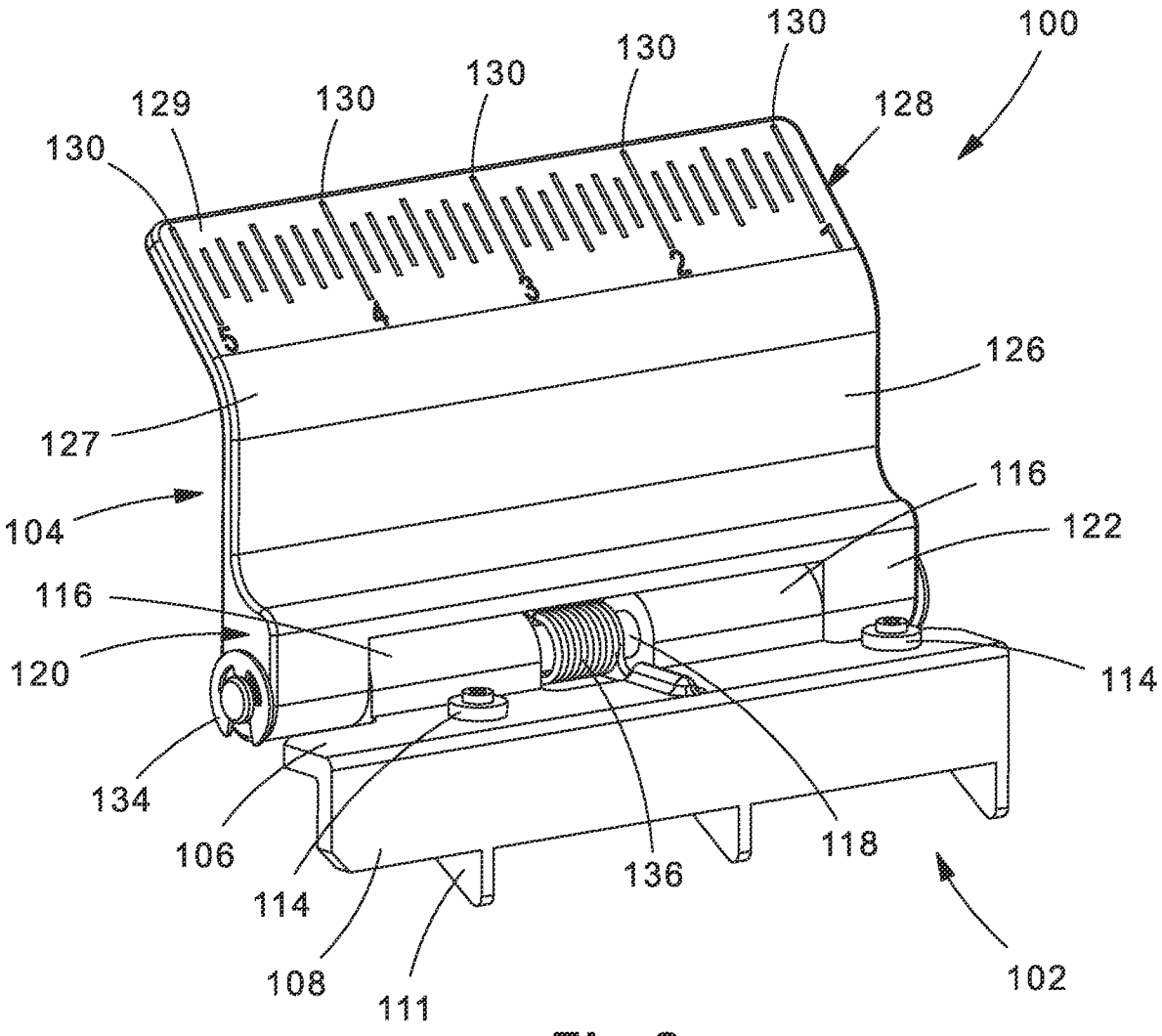
FIG. 2 is a front perspective view of the present invention of a label applicator guide.
Figure 3:
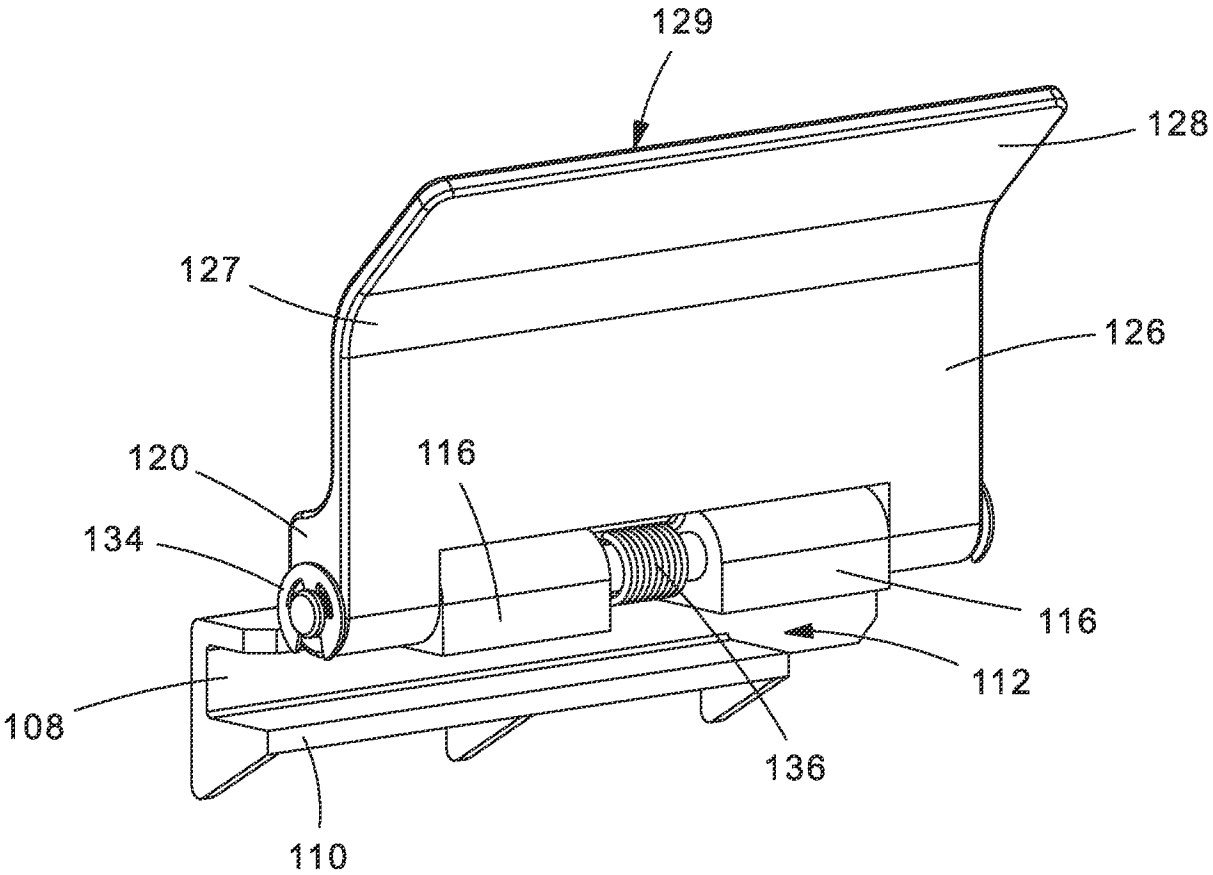
FIG. 3 is a rear perspective view of the label applicator guide of FIG. 2.
Figure 4:
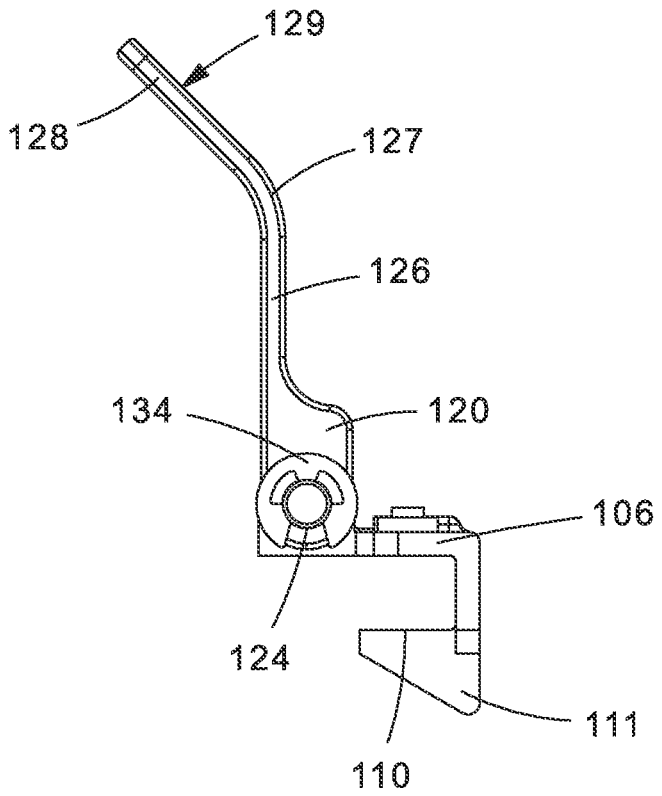
FIG. 4 is a side view of the label applicator guide of FIG. 2.

As depicted in FIG. 1, the label applicator guide 100 is mounted directly adjacent the wrapping mechanism 18. Referring to FIGS. 2-4, the label applicator guide 100 includes a base 102 and a controller 104. The base 102 includes a top 106, side 108, and bottom 110. The top 106, side 108, and bottom 110 are in a C-shaped configuration and form a channel 112. Set screws 114 may be found on the top 106 of the base 102. The set screws 114 function to secure the base 102 to the label applicator 10. The bottom 110 may include wings 111 as depicted in FIGS. 2-4. The wings 111 are used to add strength to the bottom 110 and direct forces through the base 102 during tightening of the set screws 114.

The base 102 further includes base knuckles 116 extending from the top 106 of the base 102. The base knuckles 116 include an opening 118. The base knuckles 116 and opening 118 allow for the base 102 to pivotably attach to the controller 104.

As depicted in FIGS. 2-4, the controller 104 includes a bottom portion 120. The bottom portion 120 includes a wider profile (FIG. 4) than the rest of the controller 104. The wider profile of the bottom portion 120 accommodates guide knuckles 122. The guide knuckles 122 include an opening 124. The guide knuckles 122 and opening 124 allow for the controller 104 to hingedly or pivotably attached to the base 102.

As depicted in FIG. 2, a first support 126 extends from the base portion 120. The first support 126 is generally planar with the base portion 120 and extends the width of the controller 104. A bend 127 is connected to the first support 126. A second support 128 is connected to the bend 127 and extends from the first support 126. The second support 128 includes a front face 129. As depicted in FIGS. 2-4, the second support 128 extends away from the first support 126 at an angle. Alternatively, the second support 128 may also be planar with the first support 126. The orientation of the second support 128 may be determined by the orientation of the wrapping mechanism 18, such that the front face 129 of the second support 128 is planar with a portion of the wrapping mechanism 18.

The second support 128 may include indicia or measurement markings 130 along the front face 129 as depicted in FIG. 2. The indicia 130 of FIG. 2 are depicted in the units of inches, however, metric units or any other indicia indicating measurement units may be utilized. The indicia 130 of the label applicator guide 100 will be further described below.

As depicted in FIGS. 2-4, the base 102 is hingedly connected to the controller 104 by a pin 132. The pin 132 extends through the openings 118 in the base 102 and the openings 124 in the controller 104. The pin 132 may be fastened in place using a fastener 134, such as an E-clip, as depicted in FIGS. 2-4. It is contemplated that other joining and fastening mechanisms may be implemented in place of the pin 124 and E-clip 134 to pivotably join the base 102 to the controller 104.

A retention spring 136 is located between the base knuckles 116 and encompasses the pin 132 as is depicted in FIGS. 2 and 3. The retention spring 136 includes a portion mounted to the base 102 and a portion mounted to the controller 104. The retention spring 136 may be to keep the controller 104 in a vertically biased position as depicted in FIGS. 2-4.

Figure 5:
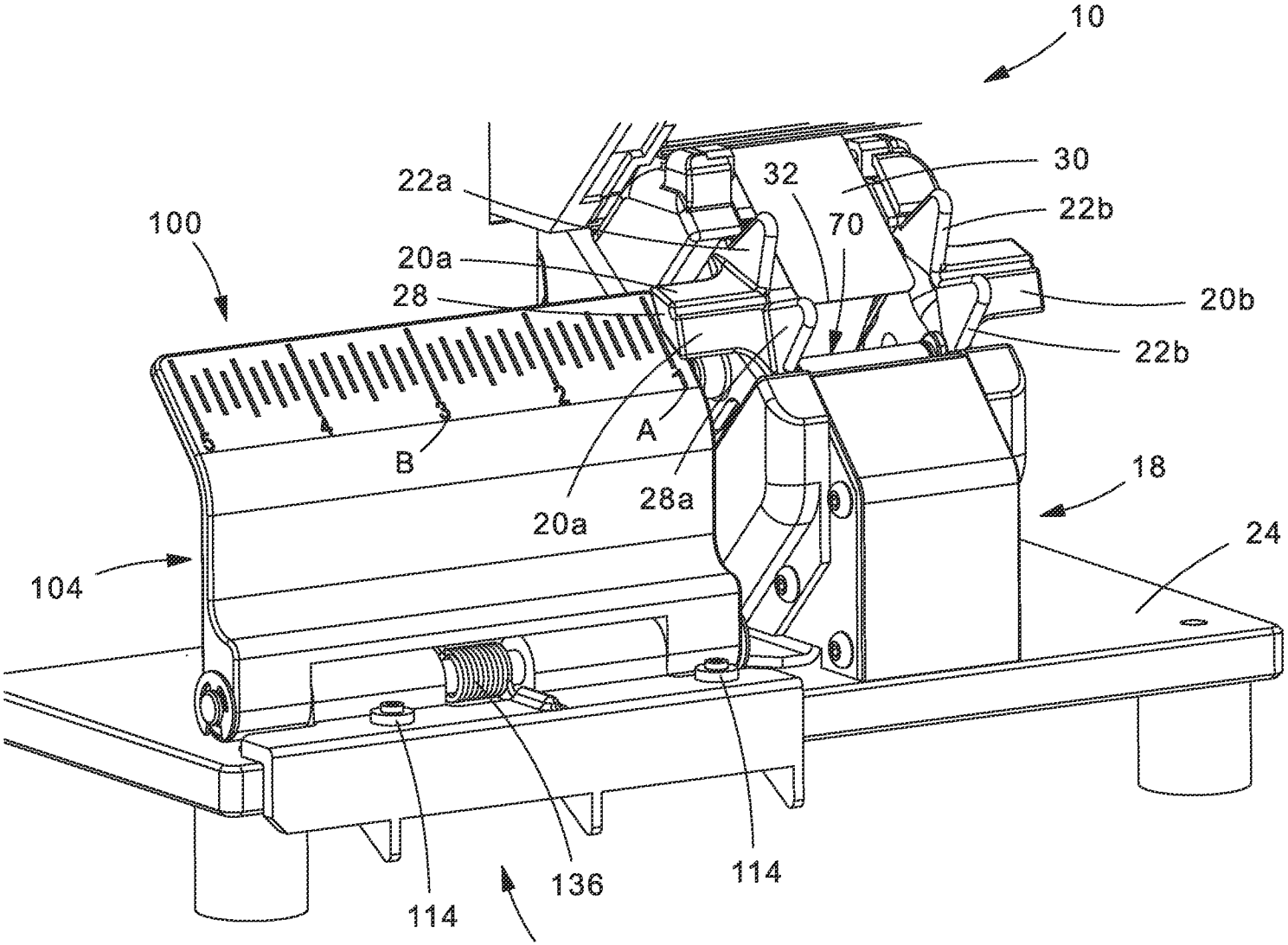
FIG. 5 is a partial perspective view of FIG. 1, depicting the label applicator guide and elongated label applicator.

FIG. 5 depicts the label applicator guide 100 connected to the label applicator 10 with a label 30 presented for attachment to an elongated object. The base 102 of the label applicator guide 100 is mounted to a base plate 24 of the label applicator 10. As depicted in FIG. 5, the base plate 24 mounts within the channel 112 of the label applicator 100. The set screws 114 are tightened to affix the label applicator guide 100 to the label applicator.

The label applicator guide 100 depicted in FIG. 5 is mounted onto the base plate 24 of the label applicator 10, directly adjacent to the wrapping mechanism 18. As referenced above, the wrapping mechanism 18 includes the first wire guide 20*a* and second wire guide 20*b*. The first wire guide 20*a* and second wire guide 20*b* are located on each side of a central portion 70 of the wrapping mechanism 18. The first wire guide 20*a* and second wire guide 20*b* each include a guide post 22 (specifically guide posts 22*a*, 22*b*) and first and second finger grips 26*a*, 26*b*. The guide posts 22*a*, 22*b* extend up from the wire guides 20*a*, 20*b*. The guide posts 22*a*, 22*b* direct the wire or cable to the central portion 70 of the wrapping mechanism 18. The finger grips 26*a*, 26*b* extend horizontally from the guide posts 22*a*, 22*b*. The finger grips 26*a*, 26*b* are configured to support the elongated object within the wrapping mechanism 18.

The first wire guide 20*a* and second wire guide 20*b* act as sleds to guide the elongated object into the central portion 70 of the wrapping mechanism 18 for the label 30 to be applied by the wrapping mechanism 18 as described in U.S. patent application Ser. No. 16/279,298.

A free end 28 of the finger grip 26*a* may extend over an edge of the controller 104 and align with the indicia 130. In this configuration, the retention spring 136 can act a force upon the controller 104 and retain the controller 104 against the finger grip 26*a*.

The label applicator guide 100, as depicted in FIG. 5, is mounted to the base plate 24 of the label applicator 10 such that the measurement of the indicia 130 correlate with the distance from the label 30 within the central portion 70 of the wrapping mechanism 18. The measurement may be taken from any point on the label 30 within the central portion 70. Typically, the measurement is taken from the edge of the label closest to the end of the elongated object 82. Specifically, the indicia 130 marked as "1" noted at A in FIG. 5, denotes a measured distance of 1 inch from the label 30. Likewise, the indicia 130 marked as "3" noted at B denotes a measured distance of 3 inches from the label 30. The indicia 130 depicted in the figures are in the units of inches, however, metric units or any other indicia indicating measurement units or lengths correlating to a length of the elongated object may be utilized.

Figure 6:
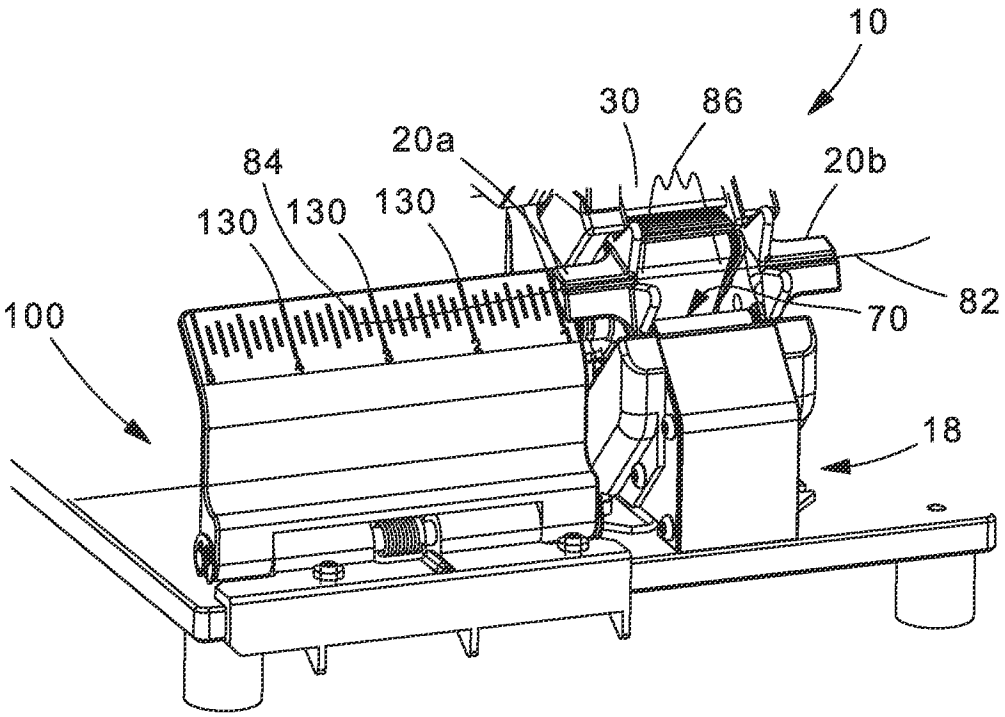
FIG. 6 is the label applicator guide and elongated label applicator of FIG. 5 with a measured wire or cable that is prepared for labeling.
Figure 7:
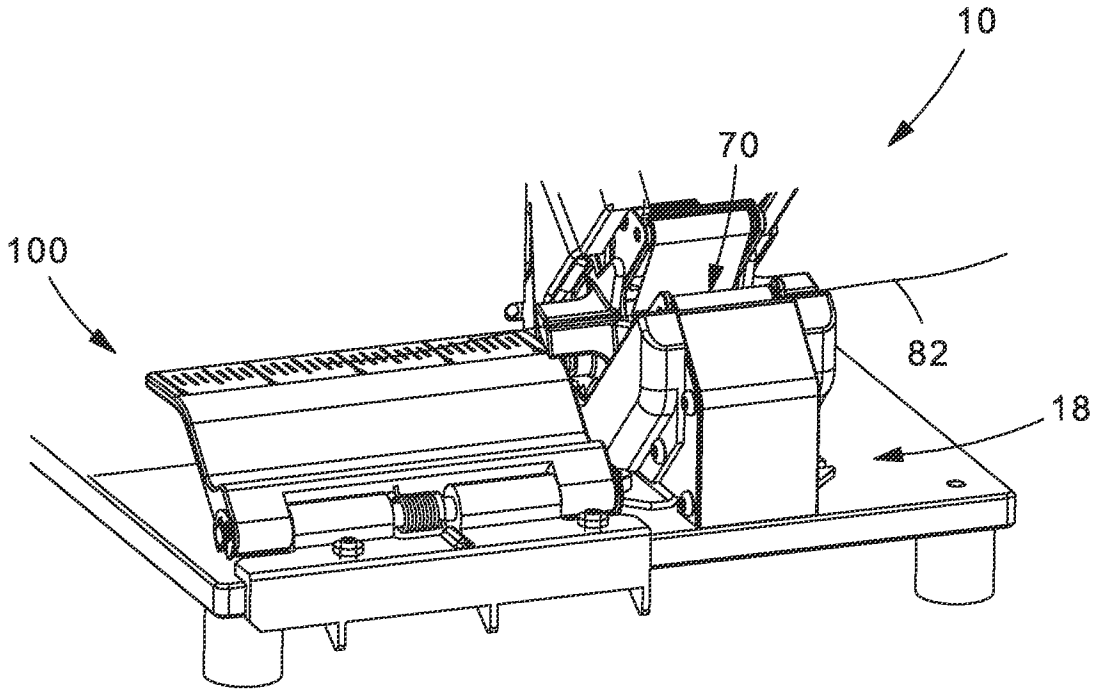
FIG. 7 is the label applicator guide and elongated label applicator of FIG. 5, with the wire or cable inserted into the wrapping mechanism for labeling.

FIGS. 6 and 7 depict the label applicator guide 100 connected to the label applicator 10 and including an elongated object 82. The elongated object 82 includes a first end 84 positioned over the label applicator guide 100 and a labeling section 86 positioned between the wire guides 20*a*, 20*b*. The first end 84 is a termination end of the elongated object 82, near where the label 30 is to be placed. The label section 86 is the portion of the elongated object 86 where the label 30 is intended to be placed.

FIG. 6 depicts the label section 86 the elongated object 82 positioned between the wire guides 20*a*, 20*b* of the wrapping mechanism 18 in preparation for applying the label 30. The label 30 may be presented for labeling, with the adhesive side up as described in U.S. patent application Ser. No. 16/279,298. A leading edge 32 of the label 30 will extend past a center of the central portion 70 in the wrapping mechanism 18.

The user may wish to apply the label 30 at a set distance when using the label applicator 10. The user may align the end 84 of the elongated object 82 with the selected measurement indicia 130, i.e. 1, 2, 3, etc. While holding the end 84 of the elongated object 82 at the selected indicia point, a user may place labeling section 86 of the elongated object 82 between the wire guides 20*a*, 20*b* of the wrapping mechanism 18 so that the surface of the object 82 first contacts an adhesive on the adhesive side of the label 86.

The user may then depress the elongated object 82 into the wrapping mechanism 18 by depressing the wire guides 20*a*, 20*b* along with the elongated object 82 into the central portion 70. The wire guides 20*a*, 20*b* will follow a linear path and travel into the wrapping mechanism 18. As the wire guides 20*a*, 20*b* travel into the wrapping mechanism 18, the first finger grip 26*a* of wire guide 20*a* will act on the controller 104 and cause the controller 104 to rotate with the linear movement of wire guide 20*a*. During this operation, the user may maintain control of the elongated object 82 against the label applicator guide 100 by holding the elongated object 82 against the controller 104 and wire guide 20*a* at the same time, while the wire guides 20*a*, 20*b*, move linearly into the central portion and at the same time the controller 104 pivots as a result of the wire guides 20*a*, 20*b*, linear movement.

FIG. 7 depicts the elongated object 82 within the central portion 70 of the wrapping mechanism for application of the label. Once the elongated object 82 is inserted fully into the central portion 70, the rotational device (not shown) of the wrapping mechanism 18 orbits about the object 82 causing the label 30 (not viewable) to be pushed against the object 82 from all angles as detailed in U.S. patent application Ser. No. 16/279,298. Once labeling is completed, the user may remove the elongated object 82 from the wrapping mechanism 18. The above process can be repeated for labeling additional elongated objects.

The illustrations of the embodiments described herein are intended to provide a general understanding of the structure of the various examples. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

What is claimed is:

1. A method of applying an adhesive label to an elongated object at a set distance comprising the steps of:

feeding a label from a source of labels to a wrapping mechanism of an elongated object label applicator;

aligning an elongated object with indicia of a label applicator guide, wherein the indicia of the label applicator guide is configured for measuring a length of the elongated object placed in the wrapping mechanism;

placing the elongated object within a wire guide of the wrapping mechanism;

depressing the wire guide and label applicator guide to place the elongated object within the wrapping mechanism; and rotating a rotational device of the wrapping mechanism about an axis of rotation to apply the label.

2. The method of claim 1, wherein the label applicator guide includes a base and a controller configured to guide the elongated object into the wrapping mechanism to apply the label, wherein the controller is moveably secured to the base adjacent to the wrapping mechanism configured to guide the elongated object into the wrapping mechanism to apply the label.

3. The method of claim 2, wherein the controller is moveably secured to the base in a pivoting relationship through a first knuckle of the controller pivotably connected to a second knuckle of the base, with a pin extending through the first knuckle and second knuckle.

4. The method of claim 2, wherein the base includes a top portion, side portion, and base portion in a C-shaped configuration forming a channel and wherein the channel of the base mates to a base plate of the elongated object label applicator.

5. The method of claim 2, wherein the controller pivots about the base to guide the elongated object into the wrapping mechanism.

6. The method of claim 2, wherein the wrapping mechanism includes a wire guide configured to cradle the elongated object and direct the elongated object into a central portion of the wrapping mechanism, and wherein the controller is configured to move in unison with the wire guide.

7. The method of claim 2, wherein the controller includes a first support extending from the base and a second support extending from the first support such that the second support is planar with a wire guide of the wrapping mechanism.

8. The method of claim 7, wherein the second support includes indicia for measuring a length of the elongated object placed in the wrapping mechanism.

* * * * *